United States Patent [19]

Jang

[11] Patent Number: 4,694,670

[45] Date of Patent: Sep. 22, 1987

[54] COMBINED KEY AND COMBINATION LOCK

[76] Inventor: Young H. Jang, San Francisco Calle 72, Casa 38, Panama City, Panama

[21] Appl. No.: 687,938

[22] Filed: Dec. 31, 1984

[51] Int. Cl.[4] ..... E05B 37/08

[52] U.S. Cl. ..... 70/303 R; 70/323; 70/303 A; 292/34

[58] Field of Search ..... 70/284, 339, 114–120, 70/302, 303 R, 303 A, 323, 325; 292/34, 36, 159, 170

[56] References Cited

U.S. PATENT DOCUMENTS

| | | | |
|---|---|---|---|
| 2,081,271 | 5/1937 | Ellithorpe | 70/284 |
| 2,575,674 | 11/1951 | Miller | 70/284 |
| 2,722,820 | 11/1955 | Coffey | 70/303 A |
| 2,766,606 | 10/1956 | Whitehead | 70/303 A |
| 2,766,608 | 10/1956 | Hirn | 70/303 A |
| 2,897,376 | 7/1959 | Rieckman | 70/284 |
| 3,416,337 | 12/1968 | Hutchins | 70/284 |
| 3,455,125 | 7/1969 | Silva | 70/284 |
| 3,559,430 | 2/1971 | Waller | 70/284 |
| 3,616,667 | 11/1971 | McGourty | 70/323 |
| 3,903,718 | 9/1975 | Fish | 70/284 |
| 4,398,470 | 8/1983 | Williams et al. | 70/284 |
| 4,470,277 | 9/1984 | Uyeda | 70/284 |
| 4,574,603 | 3/1986 | Parma | 70/323 |

FOREIGN PATENT DOCUMENTS

| | | | |
|---|---|---|---|
| 507545 | 11/1954 | Canada | 70/303 A |
| 2343109 | 9/1977 | France | 70/303 A |
| 1165989 | 10/1969 | United Kingdom | 70/284 |
| 1184442 | 3/1970 | United Kingdom | 70/303 R |
| 2067648 | 7/1981 | United Kingdom | 70/303 R |

*Primary Examiner*—Gary L. Smith
*Assistant Examiner*—Vinh Luong
*Attorney, Agent, or Firm*—Roger A. Marrs

[57] ABSTRACT

A combined key and combination lock herein having a housing fixed to a door which mounts a linear key lock mechanism including spring biased pins or tumblers displaced and aligned by a coded key and a rotary combination lock mechanism including notched or keyed disks selectively aligned by rotation of a numerical dial via a disk transfer mechanism. Shaft and gear members intercouple the key lock mechanism with combination lock mechanism with combination lock mechanism for cooperatively operating a latch bolt to a lock position while a resilient bias device returns the latch bolt to an unlock position. A clutch mechanism selectively disengages the key lock mechanism from the combination lock mechanism so that the numerical dial on the inside of the door may be used solely for unlatching the bolt from its lock position. A releasable stop plunger is spring biased on the housing for disabling both the key lock mechanism and the combination lock mechanism to retain the bolt in its lock position.

1 Claim, 9 Drawing Figures

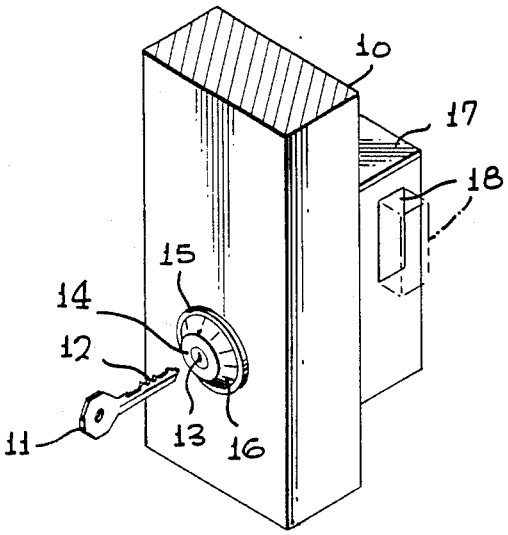
FIG. 1
FIG. 2
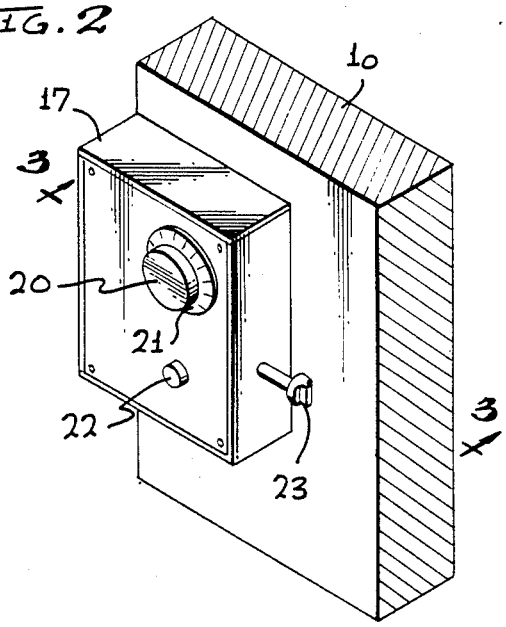
FIG. 3
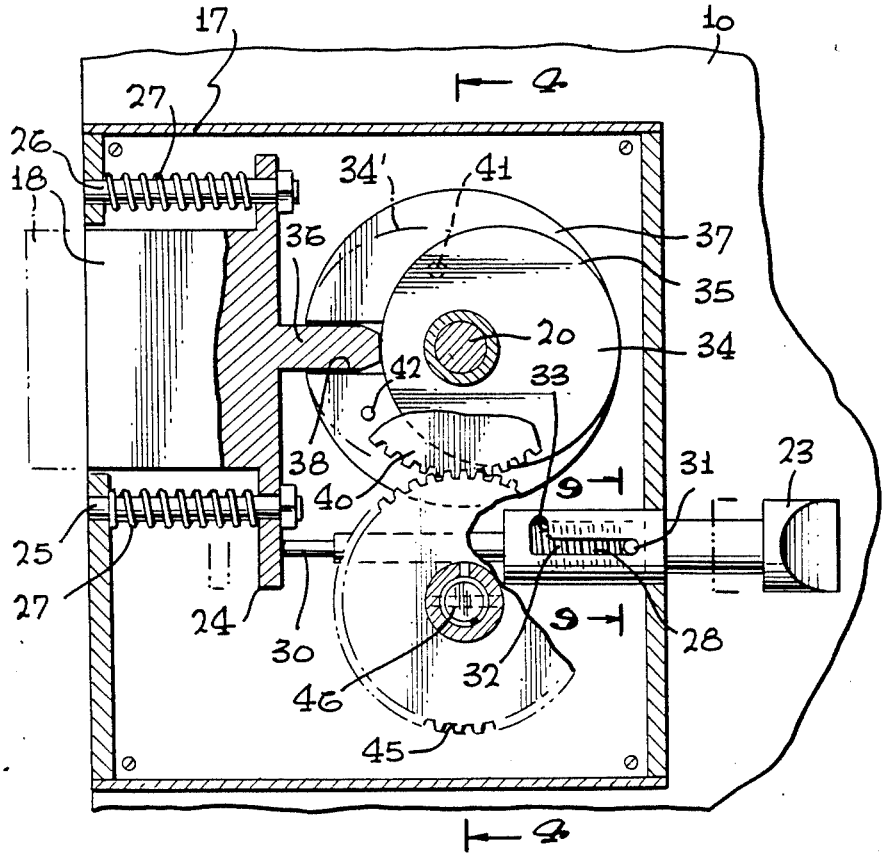

FIG. 4
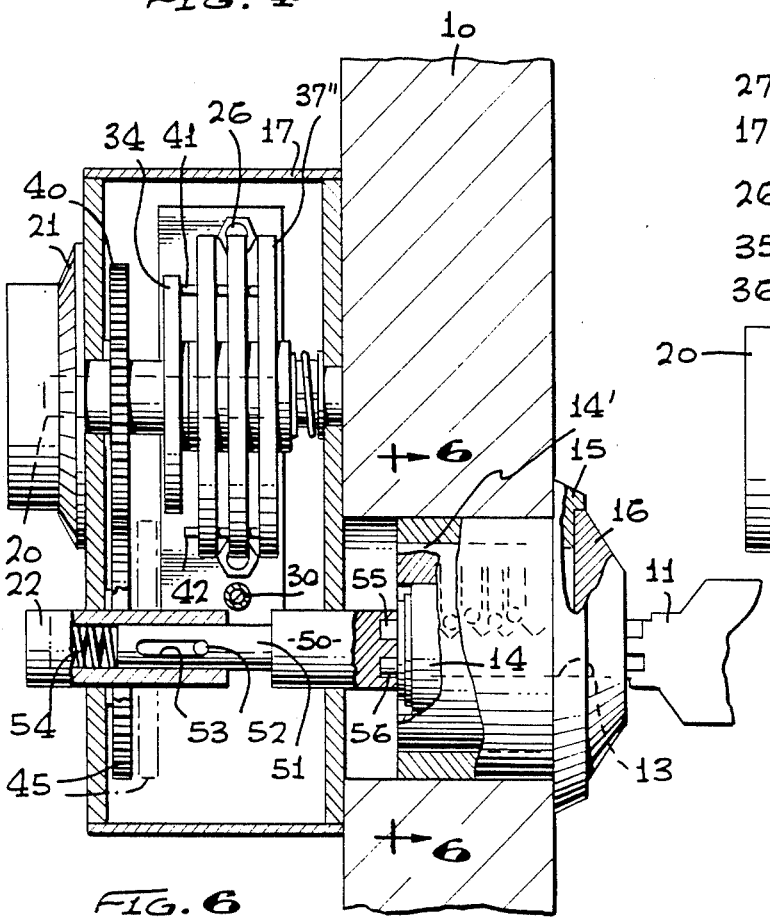
FIG. 5
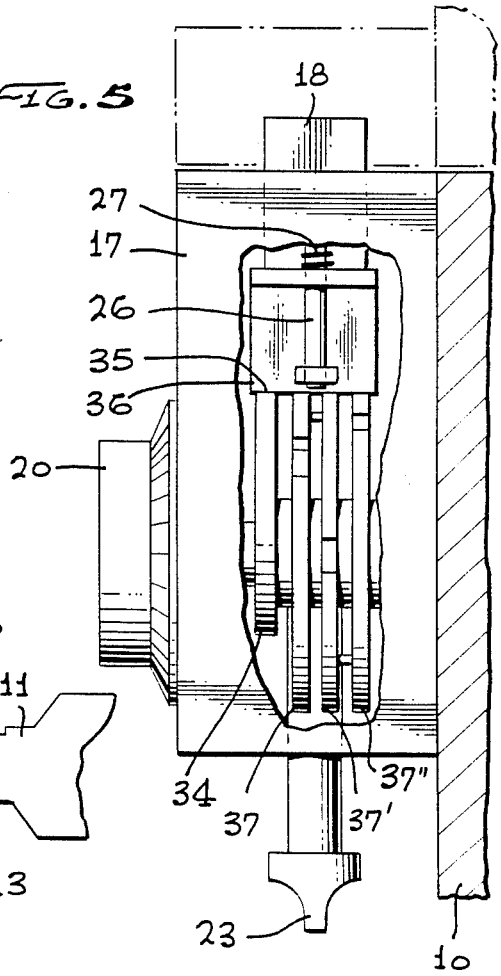
FIG. 6
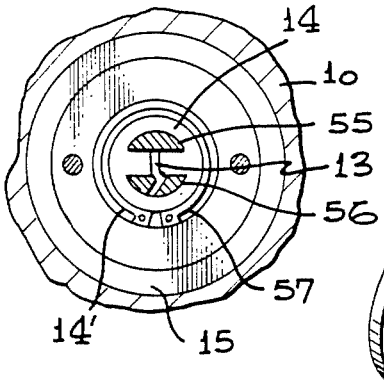
FIG. 7
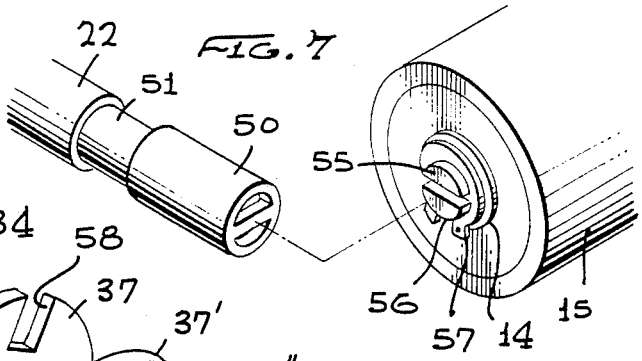
FIG. 9
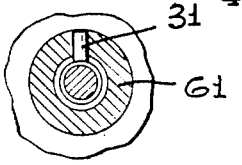
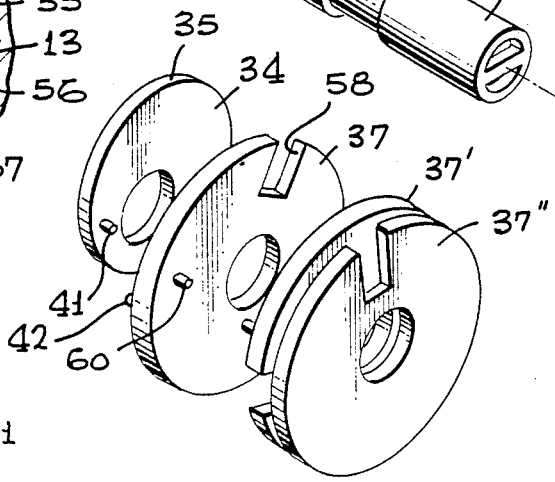
FIG. 8

COMBINED KEY AND COMBINATION LOCK

BACKGROUND OF THE INVENTION

1. Field of the Invention

The present invention relates to lock mechanisms and, more particularly, to a novel lock having a rotary combination mechanism functioning in cooperation with a key lock mechanism whereby the latching bolt is operated to an unlocked position in response to proper coding of a rotary numerical dial of the combination lock mechanism with the insertion of a notched coded key into the key lock mechanism.

2. Brief Description of the Prior Art

In the past, it has been the conventional practice to lock a door to a door jamb by employing a conventional dead bolt. The dead bolt is moved into and out of a locking position by means of either a key lock mechanism responsive to the insertion of a coded key which in combination with resilient pins or tumblers aligns a rotating cylinder with its housing to permit rotation of the cylinder and actuation of the dead bolt. Another means for operating the bolt takes the form of a rotary combination lock wherein the rotating cylinder aligns a plurality of pins or the like so that upon a predetermined positioning thereof, the bolt is moved from one position to another.

Although these prior key locks and combination locks have been effective for their intended purpose, it is possible to breach the security of these locks by a variety of means. However, it is believed that by providing both a key lock mechanism and a combination lock mechanism which is interconnected by a suitable mechanical means, both the coded key and the coded combination would be required to operate the latching bolt. By such a means, the authorized personnel must not only have a physical key with the proper code thereon for actuating the bolt but must have a code which is memorized and which must be used in combination with the key for actuating the latch bolt.

Furthermore, problems have also been encountered with conventional locks which stem from the fact that the lock is operated from the front of the door and cannot be unlocked from the inside of the door at the selection of a person occupying the room. Therefore, the presence or utilization of a clutch mechanism for disabling the lock mechanism from frontal operation so as to permit unlocking only from the rear or inside would overcome this problem. Also, means for overriding both the combination lock and the key lock mechanism is needed whereby the latch will be maintained in its locked position regardless of key or combination lock mechanism operation.

In view of the foregoing, it is believed that a long standing need has existed to provide a combined key lock mechanism and rotary combination lock mechanism whereby both mechanisms are required for actuating a bolt into its unlocked position so that a person may gain entry into or out of a closed room.

SUMMARY OF THE INVENTION

Accordingly, the above problems and difficulties are obviated by the present invention which provides a novel combined key and combination lock apparatus which includes means for interconnecting a key lock mechanism with a rotary lock mechanism whereby coded and selective operation of both mechanisms is required to actuate a bolt from its locked position.

Means are further included for disengaging the respective mechanisms from one another so that the rotary lock mechanism may be operated to the exclusion of the key lock mechanism for unlocking the bolt from its locked position. Other means are provided for overriding both mechanisms to maintain the bolt in a manually locked position until released by the user.

Therefore, it is among the primary objects of the present invention to provide a novel combined key lock mechanism and combination lock mechanism for cooperating to selectively unlock a bolt from its locked position in a door lock apparatus.

Another object of the present invention is to provide a novel linear key mechanism and rotary combination mechanism for selectively operating a latch or bolt between locked and unlocked positions whereby the user of the mechanism must have a mentally stored combination for the rotary lock and a physical possession of a coded key for the key lock mechanism.

Yet another object of the present invention is to provide a novel combined rotary and linear key lock mechanisms which cooperatively combine with each other for locking and unlocking a bolt and which includes disabling means in the form of a clutch mechanism for permitting only the rotary mechanism to operate the bolt to the exclusion of the linear key mechanism.

BRIEF DESCRIPTION OF THE DRAWINGS

The features of the present invention which are believed to be novel are set forth with particularity in the appended claims. The present invention, both as to its organization and manner of operation, together with further objects and advantages thereof, may be best understood by reference to the following description, taken in connection with the accompanying drawings in which:

FIG. 1 is a front perspective view of the novel combined key and combination lock incorporating the present invention;

FIG. 2 is a rear perspective view of the apparatus shown in FIG. 1;

FIG. 3 is an enlarged longitudinal cross-sectional view of the combined key and combination lock apparatus of the present invention taken in the direction of arrows 3—3 of FIG. 2;

FIG. 4 is a transverse cross-sectional view of the apparatus shown in FIG. 3 as taken in the direction of arrows 4—4 thereof;

FIG. 5 is a top plan view of the combined key and combination lock apparatus having a portion broken away to illustrate the combination lock thereof;

FIG. 6 is a cross-sectional view of the coupling means between the key lock mechanism and the combination lock mechanism as taken in the direction of arrows 6—6 of FIG. 4;

FIG. 7 is an exploded perspective view showing the intercoupling means;

FIG. 8 is a perspective view of the rotating disks of the combination lock; and FIG. 9 is a cross-sectional view of the bolt stop or latch illustrated in FIG. 3 in the direction of arrows 8—8 thereof.

DESCRIPTION OF THE PREFERRED EMBODIMENT

Referring to FIG. 1, a door is illustrated by the numeral 10 on which the novel combined key lock and combination lock apparatus is mounted. A key 11 is illustrated having a plurality of notches 12 arranged along the edge thereof providing a coded arrangement adapted to be inserted into a slot 13 of a cylinder 14 carried in a housing 15. The housing 15 is secured to the door 10 and the cylinder 14, including a numerical dial 16, rotates with respect to the housing 15. Rotation occurs when the properly coded key 11 is inserted into the slot 13. Also, the cylinder and dial will rotate without insertion of the key; however, the lock cannot be actuated unless both insertion of the key and proper rotation of the numerical dial takes place. At the rear of the door or, more commonly, the inside of the door, mounts a box enclosure 17 containing the apparatus mechanism and includes a lateral opening for slidably mounting a bolt 18. The bolt is intended to protrude past the edge or end of the door 10 so as to enter a recess in a door jamb through the opening in a latch plate (not shown).

Referring now in detail to FIG. 2, the inside of the door is illustrated on which the enclosure 17 is mounted and it can be seen that a rotary shaft 20 is carried thereon including a numerical dial 21. Also, a push button clutch mechanism 22 is illustrated so that depression thereof disconnects the key lock mechanism with the combination lock mechanism so that a person on the inside of the room can unlock the bolt 18 from its latched position by means of the combination lock mechanism alone utilizing shaft 20 and numerical dial 21. Furthermore, a manually operated plunger or push rod 23 is illustrated that may be used by a person inside the room for retaining the bolt 18 in a locked or latched position disabling both the combination lock mechanism and the key lock mechanism therefrom.

Referring now in detail to FIG. 3, it can be seen that the bolt 18 includes opposite flanges, such as flange 24, which are within the housing 17 and slidably mount the bolt 18 on a pair of rods 25 and 26. Compression springs carried on the rods, such as spring 27, normally bias the bolt in an unlocked position as shown in solid lines. In a locked position, the bolt is shown in broken lines and the springs are compressed between the opposing faces of a sidewall of housing 17 and the flanges 24 of the bolt. It can also be seen that when the push rod 23 is in the solid line position, the push rod is maintained in this position by means of an expansion spring 28. When it is desired to maintain the bolt in a locked position so as to be disabled from operation by either the key lock mechanism or the combination lock mechanism, the push rod 23 is pushed in the direction of the bolt so that its end element 30 bears against flange 24 and a guide pin 31 travels through an elongated slot 32 to the end thereof when the push rod is then rotated so that the pin 31 enters a notch 33.

FIG. 3 also illustrates that shaft 20 mounts a plurality of disks including an eccentrically mounted drive disk 34 having a cam edge 35 bearing against a central projection 36 integrally carried at the rear of the bolt 18 between the supporting flanges 24. When the push rod is in its inoperative position so as to permit the normal bias of the bolt 18 to be in the solid line position shown in FIG. 3, the projection 36 will bear against the cam edge 35 of the eccentrically mounted disk 34. Therefore, it can be seen that when shaft 20 is rotated, the greater lobe portion of the cam will bear against the end of the projection 36 causing the bolt to be pushed outwardly as the shaft 20 is rotated. Such a position is illustrated in broken lines for the drive disk 34 and is indicated by the numeral 34'. Shaft 20 also mounts a plurality of coded concentric disks such as disk 37, each of which includes an elongated slot 38 for receiving the width of the projection 36 when all of the notches in the respective coded disks are in alignment.

A drive gear is indicated by numeral 40 which is fixed to the shaft 20 and rotates therewith. As the shaft 20 rotates, a drive pin 41 carried on the side of the drive disk 34 travels in a circular path to engage with a pin 42 carried on the opposing side of the coded disk 37. Therefore, it can be seen that the drive wheel 34 rotates until the pins 41 and 42 engage and the rotating movement is transferred to the coded disk 37. It is also to be noted that the opposite side of disk 37 also includes a pin which engages with a pin carried on the opposing side of an adjacent disk so that all of the disks in alignment and rotatably carried on shaft 20 will be rotated by each of the disk and pin arrangements in the series. When the proper combination of numbers has been applied through the combination lock mechanism via disk 16 or disk 21, the plurality of notches 39 in each of the plurality of coded disks will be in alignment opposed to the projection 36 so that the expansion of the spring 27 will urge the bolt and projection 36 into the aligned notches so that the bolt is moved to its unlocked position as shown in solid lines in FIG. 3.

Not only shaft 20 be rotated by employing dial 21 on the inside of the door but shaft 20 can also be rotated when drive gear 40 is in mesh with an intermediate gear 45 which is carried on the clutch push rod or button 22. Therefore, the gears 40 and 45 form an interconnecting linkage between the combination lock mechanism represented by shaft 20 and attendant drive disk 34 and coded disk 37 and the key lock mechanism which will be described with reference to FIG. 4.

Referring now in detail to FIG. 4, the key lock mechanism is shown wherein the key 11 is inserted into the slot 13 so that a plurality of pins or tumblers carried in cylinder 14 may be aligned with the coded notches so as to place the parting line of the pines along the juncture of the cylinder 14 with the fixed housing 15. Once alignment is coextensive between the opposing interfaces of cylinder 14 with the bore in the housing 15, the cylinder 14 can turn as is the conventional practice in cylinder-type key locks. Once the cylinder 14 is rotated, the rotational movement is translated to a coupling 50 which in turn causes a shaft 51 integrally therewith to rotate accordingly. Shaft 51 is insertably received within the sleeve 22. The push button sleeve 22 can be moved between the solid line position and the dotted line position as shown in FIG. 4 when it is desired to engage or temporarily disengage the intermediate gear 45 with the drive gear 40. The push button sleeve 22 is keyed to shaft 51 for rectolinear movement by means of a cross pin 52 positioned transversely through an elongated slot 53 in the shaft 51. The opposite ends of the pin 52 are carried on the sleeve 22. A spring 54 is compressed between the end of the shaft 51 and the end of the push button 22 so that the sleeve is normally biased outwardly from the housing 17 so that the intermediate gear 45 is meshed with the drive gear 40.

In FIGS. 6 and 7, it can be seen that the extreme end of the coupling 50 includes a pair of spaced recesses which are intended to insertably receive a pair of corresponding projections identified by numerals 55 and 56 that are carried on the extreme end of the rotatable cylinder 14. Therefore, the rotation of the cylinder is translated into rotation of the coupling 50 and shaft 51 as well as the sleeve 22 when the projections 55 and 56 are within the recesses at the end of the coupling 50. A snap lock ring 57 is used to retain the sleeve 14 in rotatable position with respect to the surrounding housing 15.

Referring now in detail to FIGS. 5 and 8, it can be seen that the combination lock mechanism includes the plurality of coded disks identified by numerals 37, 37' and 37''. The coded disks 37, 37' and 37'' are concentrically carried on shaft 22 but are not fixed thereon. Therefore, each of the coded wheels will separately rotate on shaft 22 but are not driven by shaft 22. The coded wheels are driven initially by the connection of pin 41 with pin 42 which in turn drives the next adjacent coded wheel by engagement of the pins on the opposing faces of the adjacent wheel or coded disk. In a broad sense, the coded disks are turned by a type of "pens-transfer mechanism" which is represented by the outwardly and laterally projecting pins from opposing faces of the coded disks. The arrangement of the pins are specifically located with respect to the numbered dial 21 and the numbered dial 16 so that a variety of numerical combinations may be used for aligning the respective notches on each one of the coded disks together so as to receive the projection 36 carried on the end bolt 18. This relationship is shown in FIG. 3 so that the projection 36 enters into the aligned notches on all three of the coded disks, In FIG. 5, the drive disk 34 is positioned so that its cam is riding against the end of the projection. Also, it can be seen that the notches on the coded disks are not in alignment and therefore the extreme peripheral edge of each of the coded disks bears slightly against the end of the projection 36. As illustrated in FIG. 8, the notch associated with disk 37 is identified by numeral 58 and the pin opposing coded disk or wheel 37' is indicated by numeral 60.

In FIG. 9, the releasable locking mechanism for maintaining the push rod 23 is illustrated wherein pin 31 is in slot 32 provided in housing 61.

Therefore, it can be seen that in order to position the bolt 18 from its locked or extended position into its retracted position within the housing 17, both the combination lock mechanism and key mechanism and key lock mechanism must be operated in accordance with both the mechanical coding on the key 11 and the memorized numerical code entered via the dial 21. When both the numerical code and the key code are applied from outside the door, the coded disks 37 will be operated into notched alignment for receiving the projection 36 on the bolt and the expansion of the springs 27 will cause the bolt to move into the housing and the projection 27 into the aligned latches. However, should only the numerical code be entered through dial 21, cylinder 14 will rotate to the exclusion of the intermediate sleeve 14' so that shaft 51 via coupling 50 will not rotate. Therefore, the intermediate gear 45 and the drive gear 40 are stationary. However, upon insertion of the proper key into the slot 13, the tumblers or pins will be in alignment to engage cylinder 14 with the intermediate sleeve 14' so that coupling 50 and shaft 51 will rotate via the projections 55 and 56 which are carried on the intermediate sleeve. Upon rotation of the sleeve, the user may now rotate dial 16 to the proper numbered combination and the coded wheels 37 will be set accordingly via the gears 45 and 40 and drive disk 34.

Should a person inside the room desire to retract the bolt into the housing, it is necessary for the user to depress the push button 22 which disengages the gear 45 from the drive gear 40 so that the dial 21 may be used for entering the proper combination into the coded disks or wheels 37. In the absence of a key in slot 13 and in the absence of depressing the push button clutch 22, the dial 21 cannot be turned since the pins and tumblers of the key lock mechanism will prevent intermediate sleeve 14' and shaft 51 from rotating.

While particular embodiments of the present invention have been shown and described, it will be obvious of those skilled in the art that changes and modifications may be made without departing from this invention in its broadest aspects and, therefore, the aim in the appended claim is to cover all such changes and modifications as fall within the true spirit and scope of this invention.

What is claimed is:

1. A combined key and combination lock comprising:

a key lock mechanism;

a combination rotary lock mechanism coaxially disposed with respect to said key lock mechanism;

a door mounted action bolt operable between a locked position and an unlocked position;

latch mechanism operated by cooperation of both said key lock mechanism and said combination rotary lock mechanism;

means interconnecting said key lock mechanism and said combination rotary lock mechanism whereby coded and selective operation of said key lock and combination rotary lock mechanisms operate said action bolt between said locked and unlocked positions via said latch mechanism;

means included in said interconnecting means for selectively disengaging said key lock mechanism and said combination rotary lock mechanism from one another so that said rotary lock mechanism operates to the exclusion of said key lock mechanism for unlocking said action bolt from said locked position;

overriding means operably coupled to said key lock mechanism and said combination rotary lock mechanism to maintain said action bolt in said locked position until released manually by a user;

said overriding means, including a manually operated push rod yieldably biased against said action bolt and further including retention means carried on said push rod in said locked position;

said interconnecting means includes a plurality of spaced apart discs, each disc having a cutout adapted to be linearly aligned to insertably receive said action bolt establishing said unlocked position and adapted to be non-linearly aligned establishing said locked position;

said interconnecting means further includes an eccentric drive cam adjacent said plurality of discs and said action bolt resiliently bearing against said drive cam to constitute a cam follower so as to move said action bolt out of said linearly aligned cutouts of said plurality of discs in response to rotation of said drive cam;

resilient means coupled to said action bolt for returning or normal biasing said action bolt into said disc aligned linear cutouts.

* * * * *